US011142918B2

(12) United States Patent
Alkhafaji

(10) Patent No.: US 11,142,918 B2
(45) Date of Patent: Oct. 12, 2021

(54) PULL BAR FOR CLICK-AND-LOCK FLOORING SYSTEMS

(71) Applicant: Ayad S Alkhafaji, San Marcos, CA (US)

(72) Inventor: Ayad S Alkhafaji, San Marcos, CA (US)

( * ) Notice: Subject to any disclaimer, the term of this patent is extended or adjusted under 35 U.S.C. 154(b) by 0 days.

(21) Appl. No.: 16/289,316

(22) Filed: Feb. 28, 2019

(65) Prior Publication Data

US 2020/0277798 A1 Sep. 3, 2020

(51) Int. Cl.

| | |
|---|---|
| ***E04F 21/22*** | (2006.01) |
| *E04F 15/02* | (2006.01) |
| *E04F 15/04* | (2006.01) |
| *E04F 15/10* | (2006.01) |

(52) U.S. Cl.

CPC ..... *E04F 21/22* (2013.01); *E04F 15/02038* (2013.01); *E04F 15/046* (2013.01); *E04F 15/048* (2013.01); *E04F 15/107* (2013.01)

(58) Field of Classification Search

CPC ..... E04F 21/22; E04F 15/048; E04F 15/107; E04F 15/02038; E04F 15/046

See application file for complete search history.

(56) References Cited

U.S. PATENT DOCUMENTS 1,159,963 A * 11/1915 Landgraf ..... E04F 21/22 81/46
1,161,207 A * 11/1915 Hagel ..... E04F 21/22 81/46
1,188,167 A * 6/1916 Foucart ..... B65G 7/12 294/26
2,518,586 A * 8/1950 Williamson ..... B66F 1/06 254/14
2,654,408 A * 10/1953 Leslie ..... E04F 21/22 81/46
4,266,586 A * 5/1981 Brown ..... B25B 27/02 254/11
4,683,631 A * 8/1987 Dobbertin ..... B25B 27/02 254/11
5,435,610 A * 7/1995 Roberts ..... E04F 21/22 254/11
5,765,808 A * 6/1998 Butschbacher ..... B25B 1/205 254/199
5,845,548 A * 12/1998 Nelson ..... E04F 21/22 81/46
5,894,705 A * 4/1999 Sutton ..... E04F 21/22 248/362
5,946,785 A * 9/1999 Muhlebach ..... E04F 21/22 254/11
5,984,271 A * 11/1999 Ellenberger ..... E04F 21/22 254/11
6,062,109 A * 5/2000 Muhlebach ..... B25B 1/205 81/46

(Continued)

*Primary Examiner* — Joshua K Ihezie

(74) *Attorney, Agent, or Firm* — John R. Ross; John R. Ross, III

(57) ABSTRACT

The present invention provides a pull bar and method for using the pull bar. The pull bar is used to pull together flooring boards that utilize a click-and-lock system. A handle is rigidly connected at an angle to a tapping block. A puller is rigidly connected to the underside of the tapping block. The puller has an angled lip that extends downward from the tapping block. A hook is connected to the angled lip and is for hooking a flooring board.

14 Claims, 9 Drawing Sheets

(56) References Cited

U.S. PATENT DOCUMENTS

| | | | | |
|---|---|---|---|---|
| 6,233,899 | B1 * | 5/2001 | Mellert | E04F 21/22<br>254/11 |
| 6,370,836 | B1 * | 4/2002 | Gunn | B25B 1/205<br>269/904 |
| 7,398,628 | B2 * | 7/2008 | Van Horne, Jr. | E04F 21/22<br>254/11 |
| 7,536,933 | B1 * | 5/2009 | Torres, Jr. | E04F 21/22<br>254/11 |
| 7,712,199 | B1 * | 5/2010 | Wilson | E04F 21/22<br>254/25 |
| 8,434,738 | B1 * | 5/2013 | Anstett | E04F 21/22<br>254/11 |
| 2002/0174607 | A1 * | 11/2002 | Omundson | E04F 21/22<br>52/127.5 |
| 2005/0252167 | A1 * | 11/2005 | Van Horne, Jr. | E04F 21/22<br>52/749.1 |
| 2006/0021475 | A1 * | 2/2006 | Solari | E04F 21/22<br>81/46 |
| 2006/0278046 | A1 * | 12/2006 | Gargano | E04F 21/22<br>81/46 |
| 2007/0022845 | A1 * | 2/2007 | Lee-Rodrigues | E04F 21/22<br>81/46 |
| 2010/0313714 | A1 * | 12/2010 | Smith | B25B 27/02<br>81/27 |
| 2013/0008290 | A1 * | 1/2013 | Bugallo | B25D 1/00<br>81/463 |

* cited by examiner

PULL BAR FOR CLICK-AND-LOCK FLOORING SYSTEMS

The present invention relates to click-and-lock flooring systems, and in particular, to pull bars for click and lock flooring systems.

BACKGROUND OF THE INVENTION

Engineered wood flooring and laminate flooring are known in the prior art. Engineered flooring is made of high-quality plywood with a veneer of pre-finished fine hardwood on top. Laminate flooring is made of thin, pressed wood board with an image of wood on top covered by a clear wear layer to protect the image.

Engineered flooring and laminate flooring are typically installed by using a click-and-lock system. There are several different click-and-lock systems available, but all use a design that can best be described as a modified tongue-and-groove. Instead of a straight tongue fitting directly into the groove on an adjoining plank, the pieces must be angled and tapped so that a shaped tongue fits into a matching groove in the adjoining piece. The planks fit together in a tight lock that can only be separated if the boards are angled back in the reverse direction. This flooring layer typically "floats" on the underlayment, with no adhesives or gluing necessary. Click-and-lock flooring may also be used for luxury vinyl tiles and planks.

FIGS. 1-4 show the prior art method for installing a click and lock engineered flooring 20. In FIG. 1, an installer is installing engineered flooring 20 utilizing a prior art click-and-lock system. FIG. 2 shows a close up, perspective view of engineered flooring boards 10*a* and 10*b*. Tongue 11 is being inserted into groove 12.

FIG. 3 shows a side view of tongue 11 and groove 12. Tongue side 15 and groove side 16 include further locking features 25 and 26, respectively, that function to hold the boards together once the boards have clicked into place (FIG. 4). To properly connect planks 10, the installer has angled board 10*b* and he is pulling it towards board 10*a*. It is necessary to angle board 10 so that tongue 11 inserts into groove 12 at the easiest, most efficient angle. The installer will pull the planks together as tight as he can with his hands, as shown in FIG. 1. Often the installer will find it necessary to tap board 10*b* with a hammer with sufficient force so that board 10*b* will click into board 10*a* and lock into position, as shown in FIG. 4.

Pull bars are known and are sometimes used during the installation process. The utilization of prior art pull bars can lead to damage of boards as the pull bar is pulled or tapped against the edge of the engineered flooring. For example, FIG. 4*b* shows prior art pull bar 93 positioned on top of board 10*b*. Hammer 94 impacting pull bar 93 can cause damage to lower edge 96 of groove side 16. Lower edge 96 takes the full force of the hammer's impact.

The prior art method shown in FIGS. 1-4*b* is currently used by most installers. Although effective to a skilled installer, it is nevertheless problematic. Over time, an installer can develop sore knees, sore hands and back problems. Also, valuable time may be wasted dealing with difficult alignment and installation problems. Furthermore, boards are sometimes damaged while trying to force a difficult click-and-lock insertion.

What is needed is a better pull bar for more efficient installation of click-and-lock flooring.

SUMMARY OF THE INVENTION

The present invention provides a pull bar and method for using the pull bar. The pull bar is used to pull together flooring boards that utilize a click-and-lock system. A handle is rigidly connected at an angle to a tapping block. A puller is rigidly connected to the underside of the tapping block. The puller has an angled lip that extends downward from the tapping block. A hook is connected to the angled lip and is for hooking a flooring board.

DETAILED DESCRIPTION OF THE PREFERRED EMBODIMENTS

Figure 1:
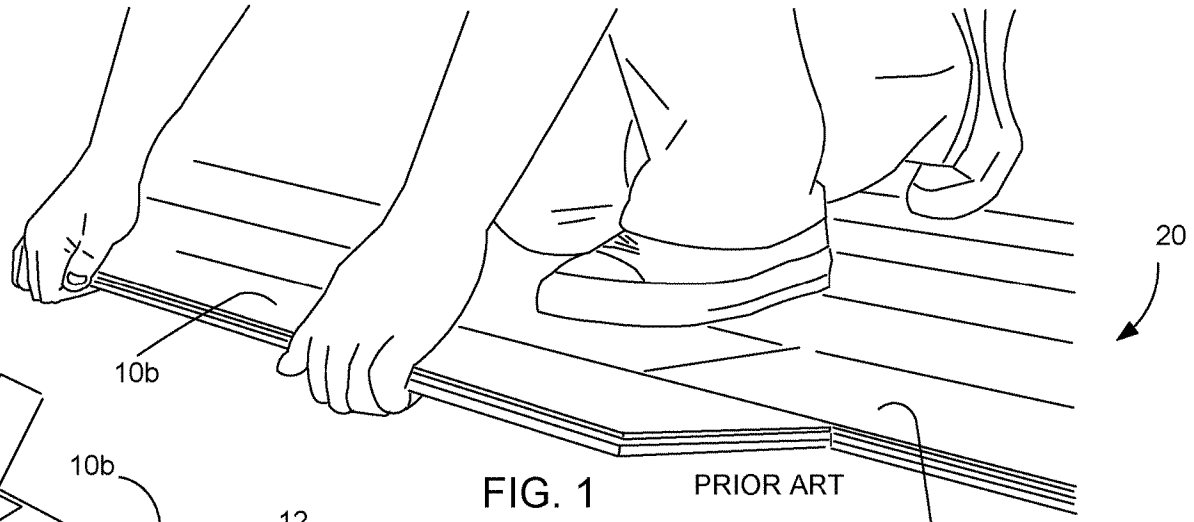
FIGS. 1-4*b* show prior art methods and devices for installing click-and-lock tongue and groove flooring.
Figure 2:
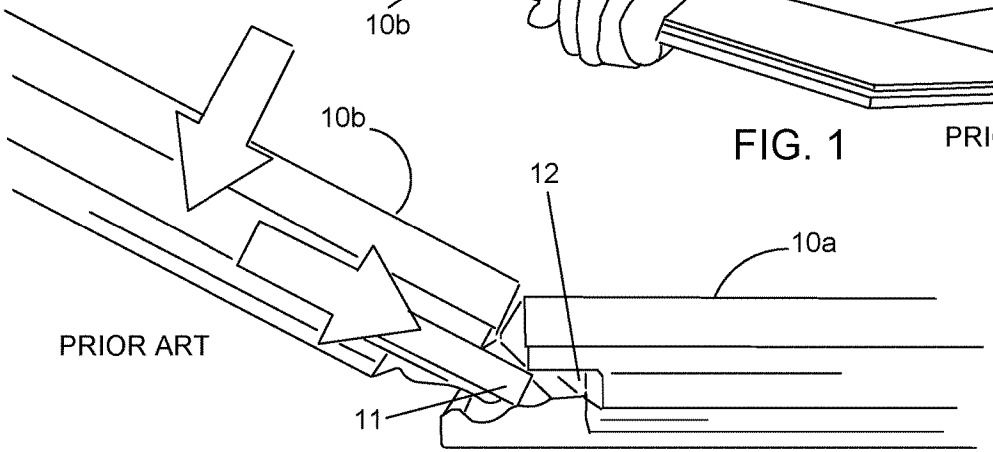
Figure 3:
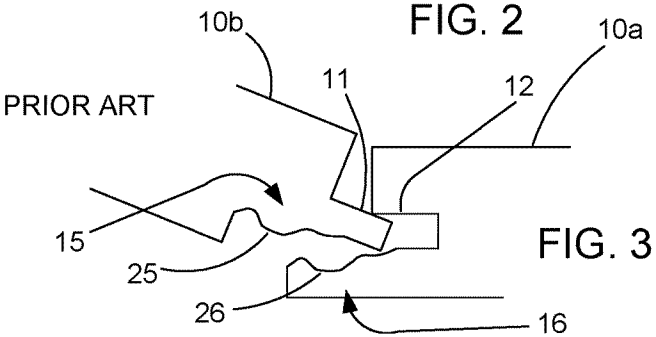
Figure 4:
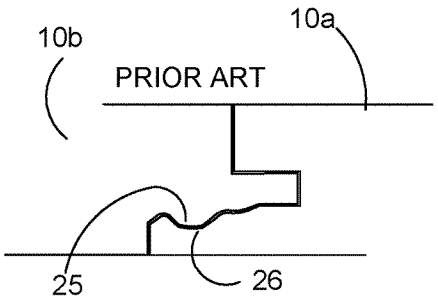
Figure 4B:
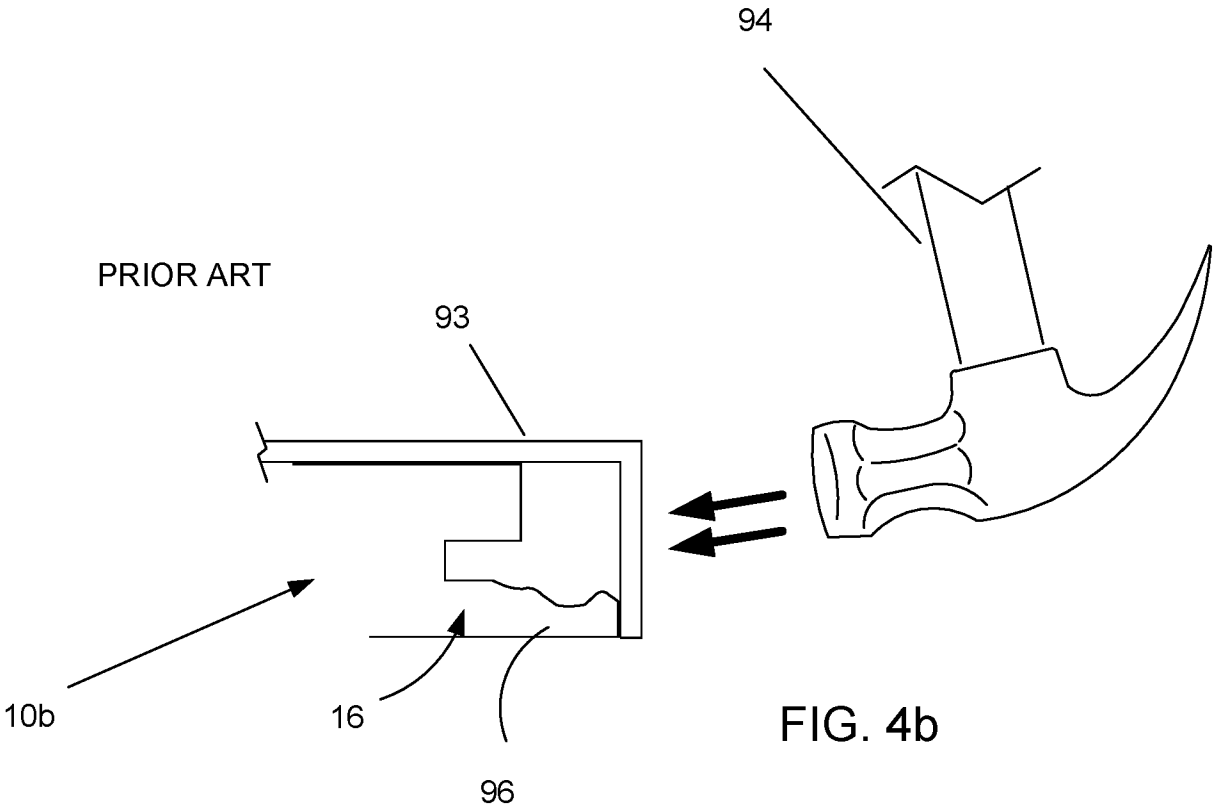
Figure 5:
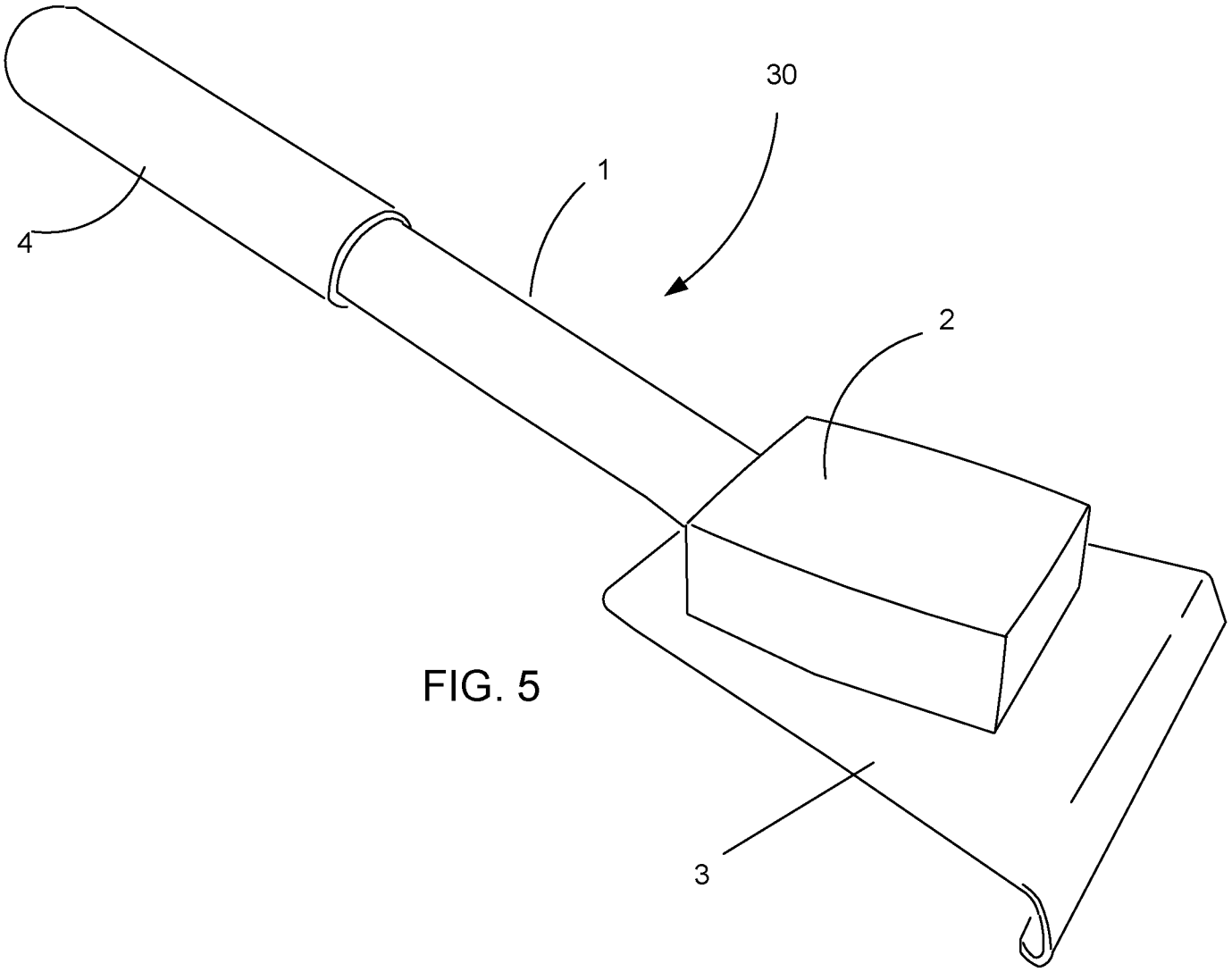
FIGS. 5 and 6 show perspective views of a preferred embodiment of the present invention.
Figure 6:
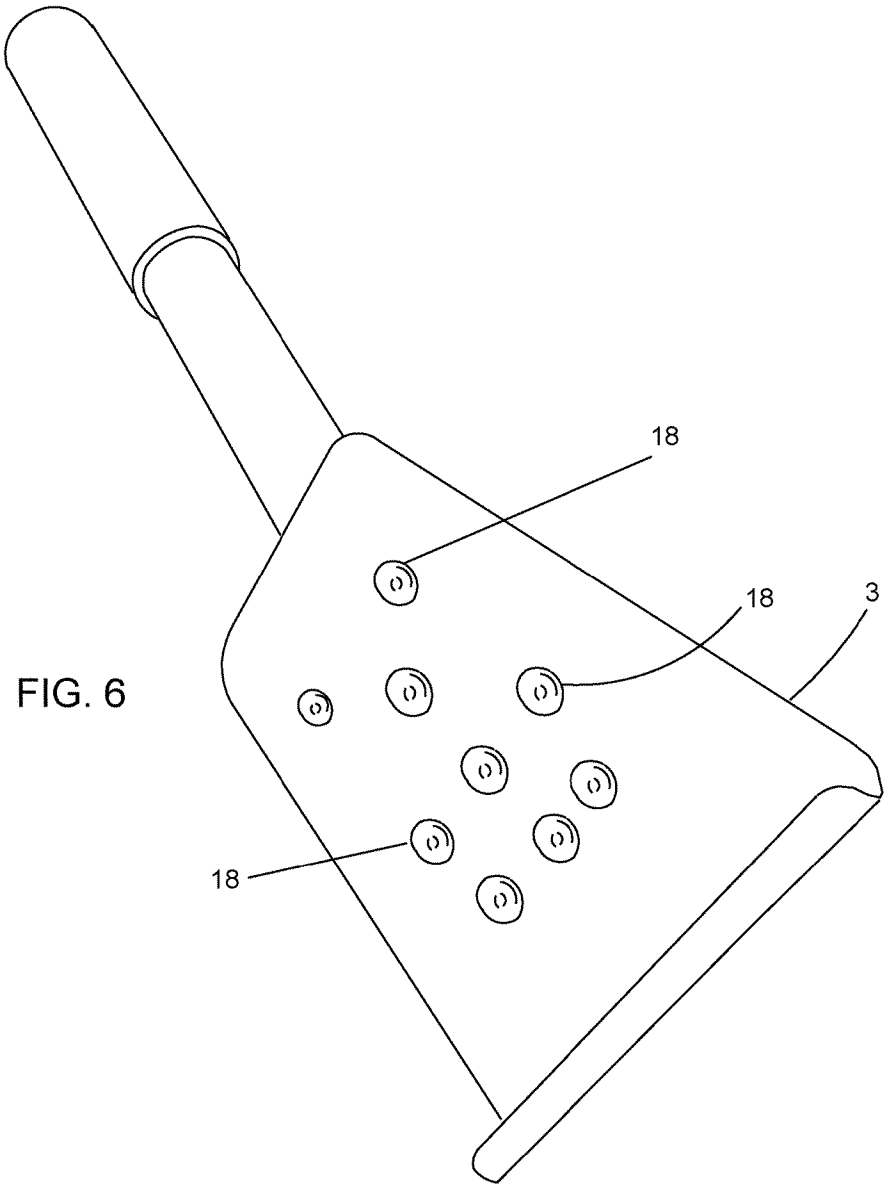

FIG. 5 shows a perspective view of a preferred embodiment of pull bar 30. Handle 1 is rigidly attached to block 2. Block 2 is rigidly attached to puller 3. Preferably handle 1 includes rubber grip 4. In a preferred embodiment handle 1, block 2 and puller 3 are fabricated from a metal or a metal allow. Handle 1 is preferably welded to block 2 and puller 3 is preferable riveted to the bottom of block 2 via rivets 18 (FIG. 6). In a preferred embodiment pull bar 30 is approximately 14 inches long.

Figure 7:
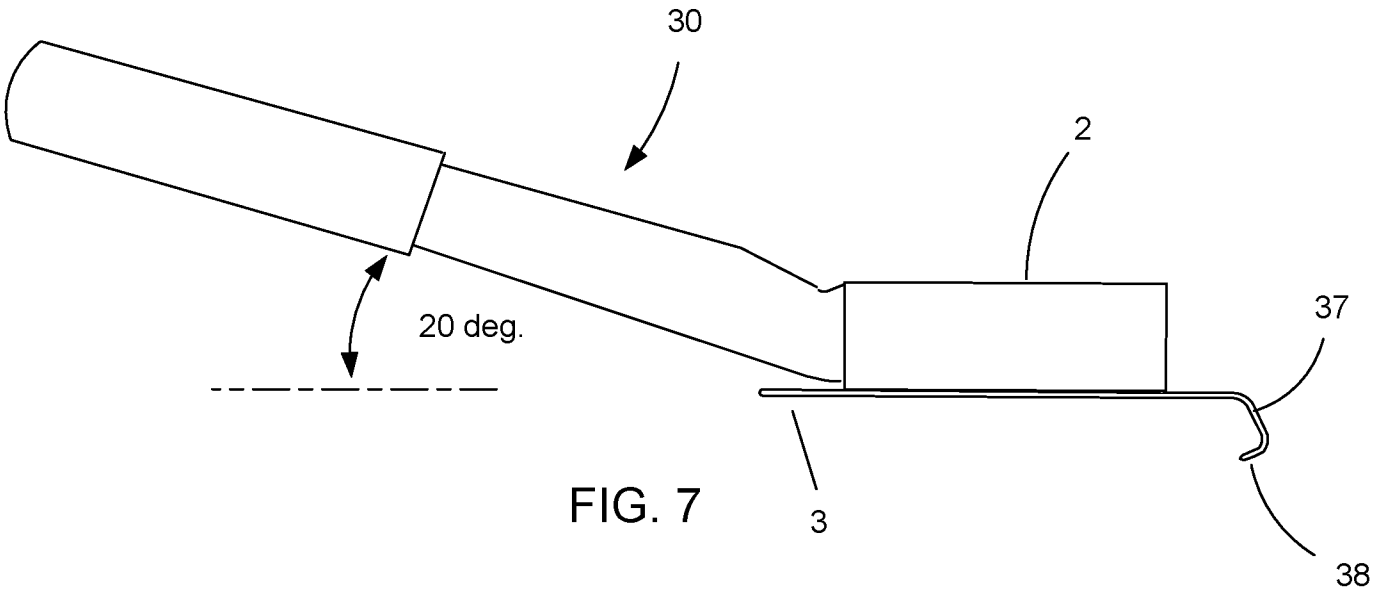
FIG. 7 shows a side view of a preferred embodiment of the present invention.

FIG. 7 shows a side view of pull bar 30. Puller 3 is approximately 5 inches long and includes angled lip 37 having lower hook 38. Angled lip a37 is not perpendicular to but is rather angled away from block 2 as shown. Lower hook 38 hooks back towards block 2 as shown. Handle 1 is rigidly connected to block 2 at an angle connection that is preferably equal to approximately a 20-degree angle from horizontal.

UTILIZATION OF THE PRESENT INVENTION

FIGS. 8-13 illustrate a preferred method of using pull bar 30.

Figure 8:
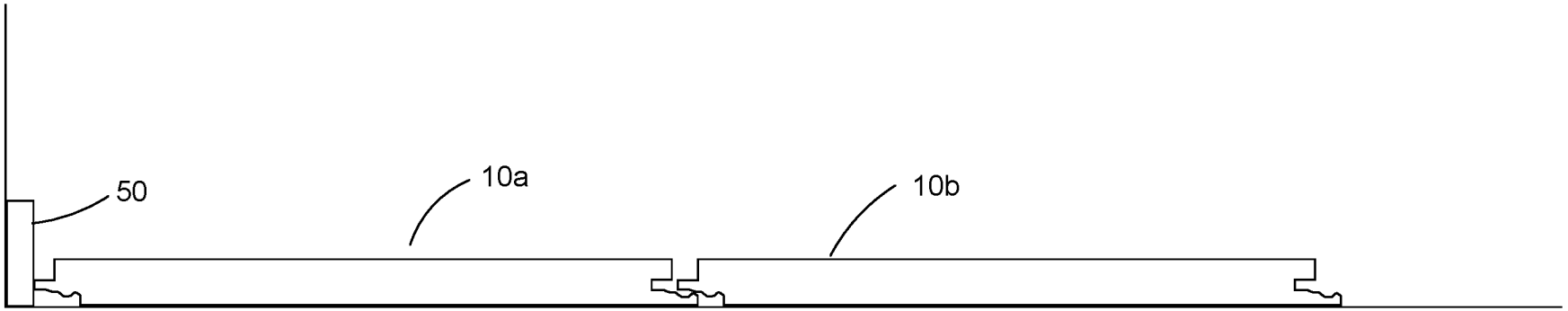
FIGS. 8-13 shows a preferred method for using a preferred embodiment of the present invention.

In FIG. 8, the installer has laid down engineered flooring board 10*a* on the floor. Spacer 50 separates board 10*a* from the wall. Board 10*b* has been placed next to board 10*a* in a position soon to be installed.

Figure 9:
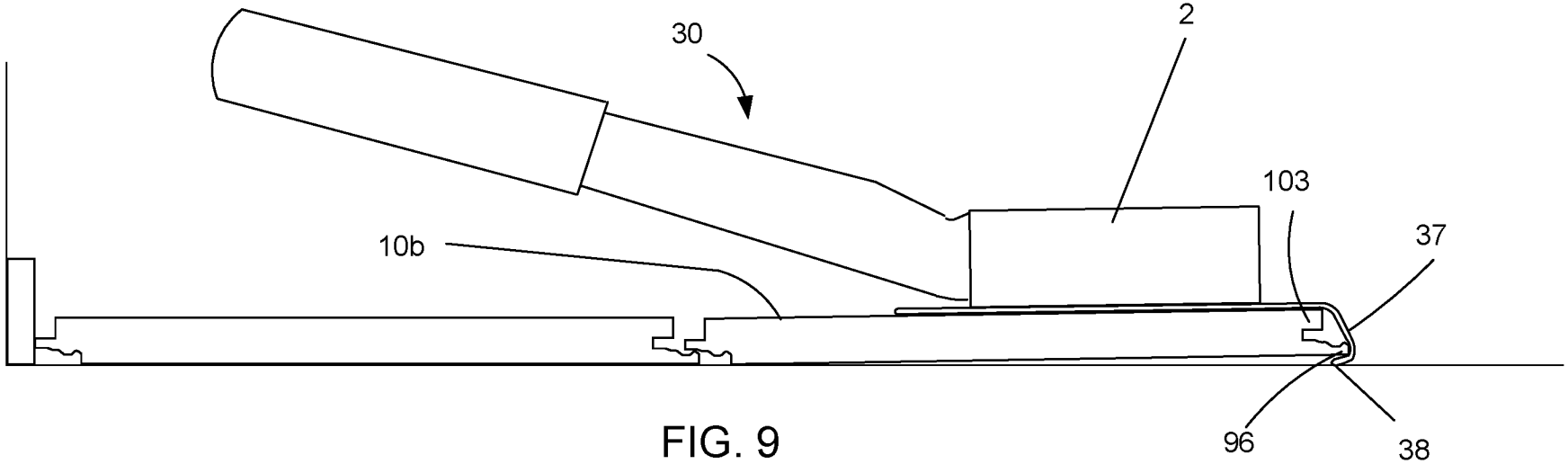

In FIG. 9 the installer has set pull bar 30 on top of board 10*b*. Angled lip 37 is angled outward away from block 2 so as to be able to reach lower edge 96 of board 10*b*. The upper portion of angled lip 37 contacts upper edge 103 of board 10*b* so that a hammer impact against tapping block 2 will have its force absorbed by both lower edge 96 and upper edge 103. This will reduce the possibility of damage to board 10*b* or to lower edge 96. Hook 38 extends underneath lower edge 96 as shown.

Figure 10:
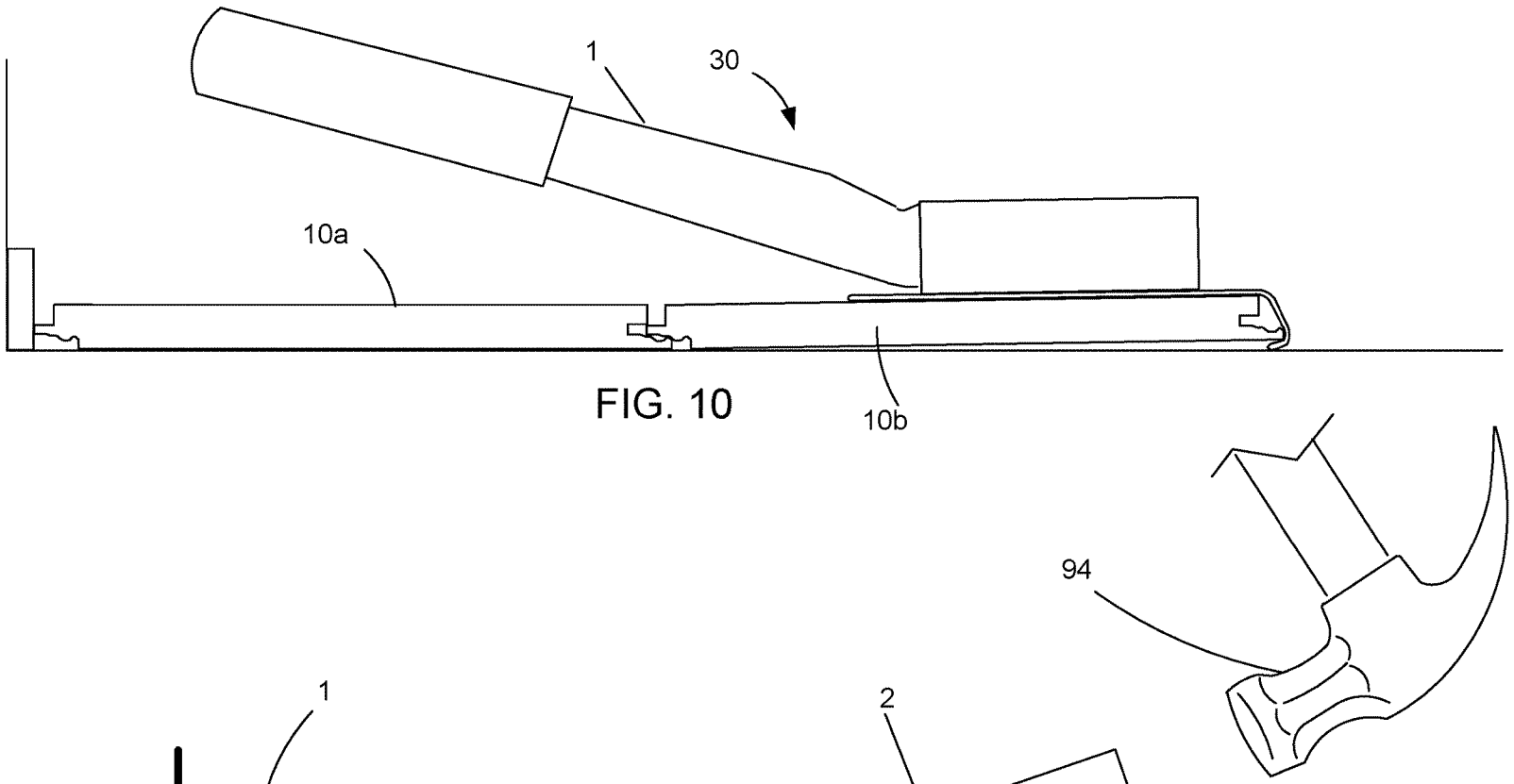

In FIG. 10, the installer has grabbed handle 1 of pull bar 30. The installer has pulled board 10*b* towards board 10*a* at only a very slight angle. The installer is stopped from pulling board 10*b* closer due to the modified tongue and groove junction between boards 10*a* and 10*b*. To properly lock board 10*b* to 10*a*, the installer will need to tilt board 10*b* to a greater angle.

Figure 11:
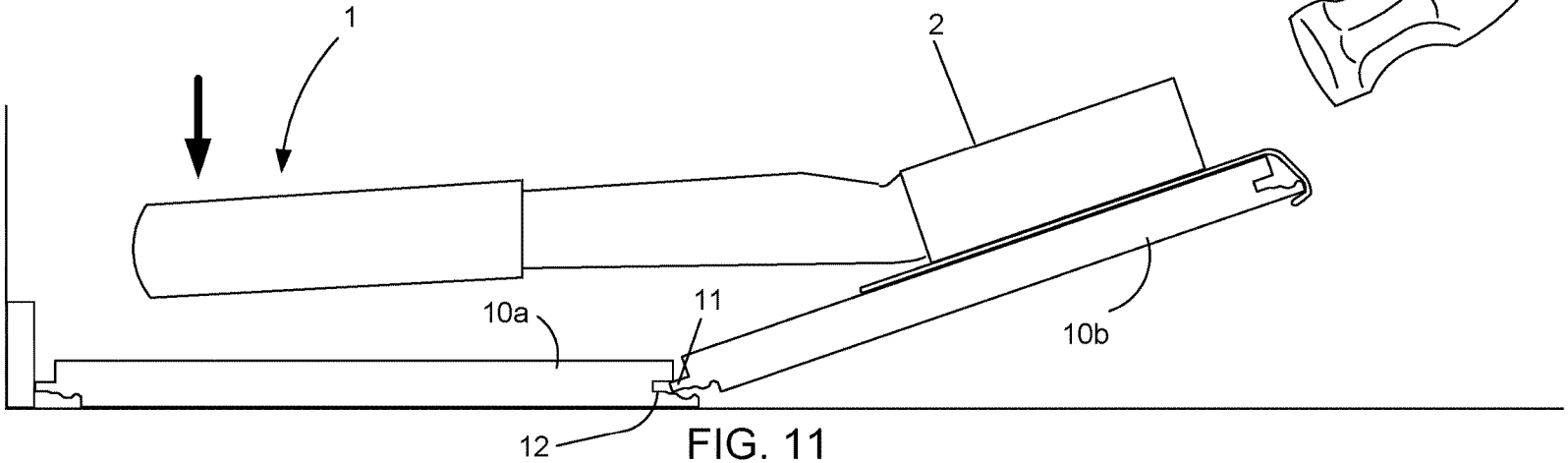

In FIG. 11, the installer has pressed down on handle 1. This has caused board 10*b* to tilt counterclockwise so that there is an increased angle between tongue 11 and groove 12. The angle will make it easier to lock board 10*b* into board 10*a* via the click-and-lock system described above. After positioning board 10*b* at the appropriate angle, the installer is tapping on block 2 with hammer 94 to easily move tongue 11 into groove 12.

Figure 12:
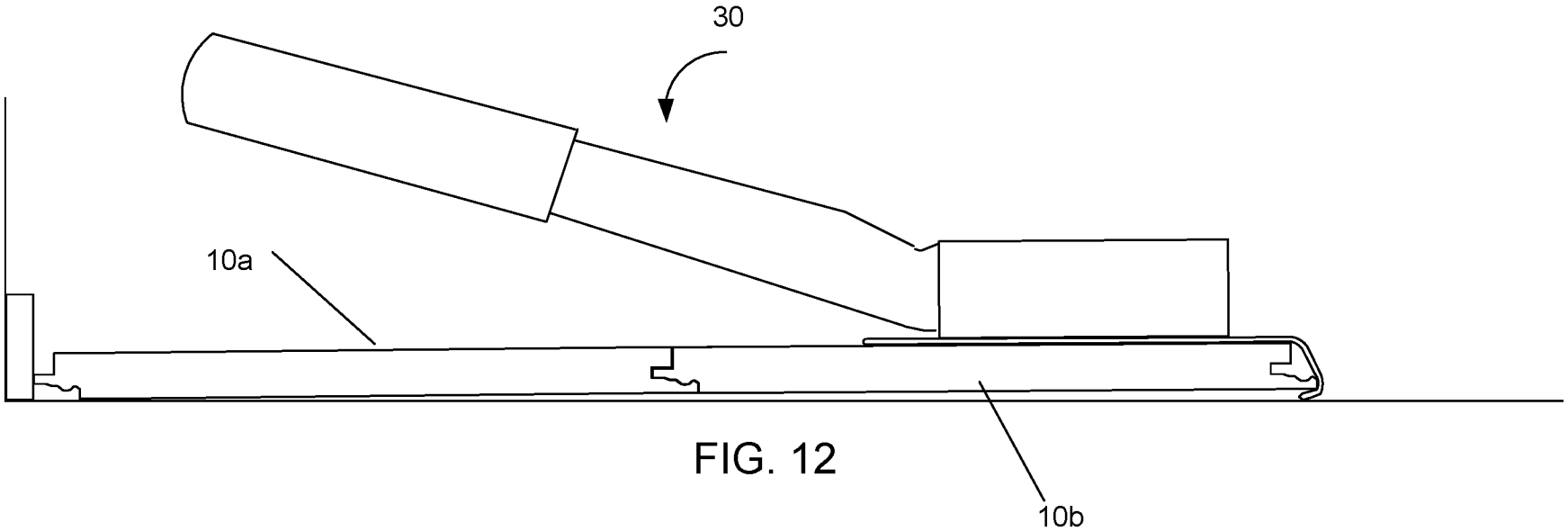

In FIG. 12 the installer has successfully locked board 10*b* to board 10*a*.

Figure 13:
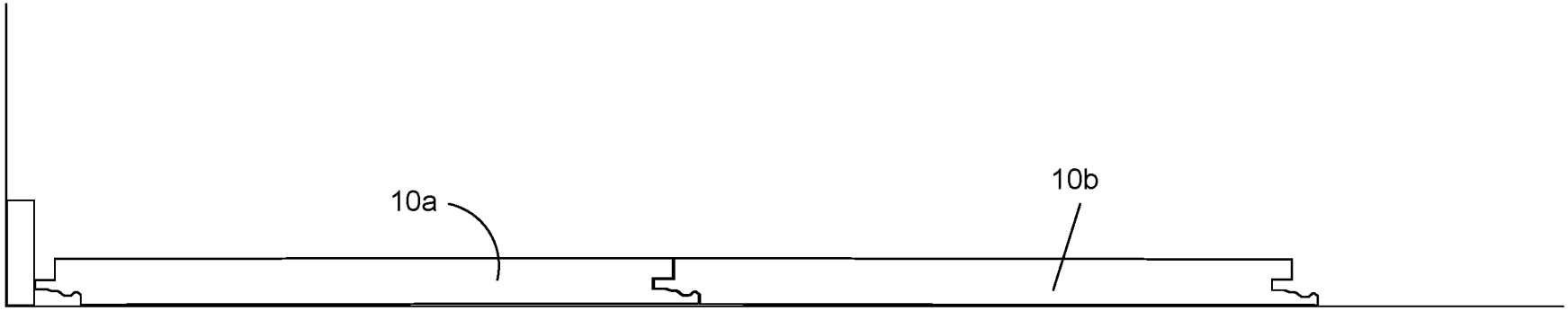

In FIG. 13 the installer has removed pull bar 30 from board 10*b*. Now further boards may be installed in a similar fashion.

OTHER PREFERRED EMBODIMENT

Figure 14:
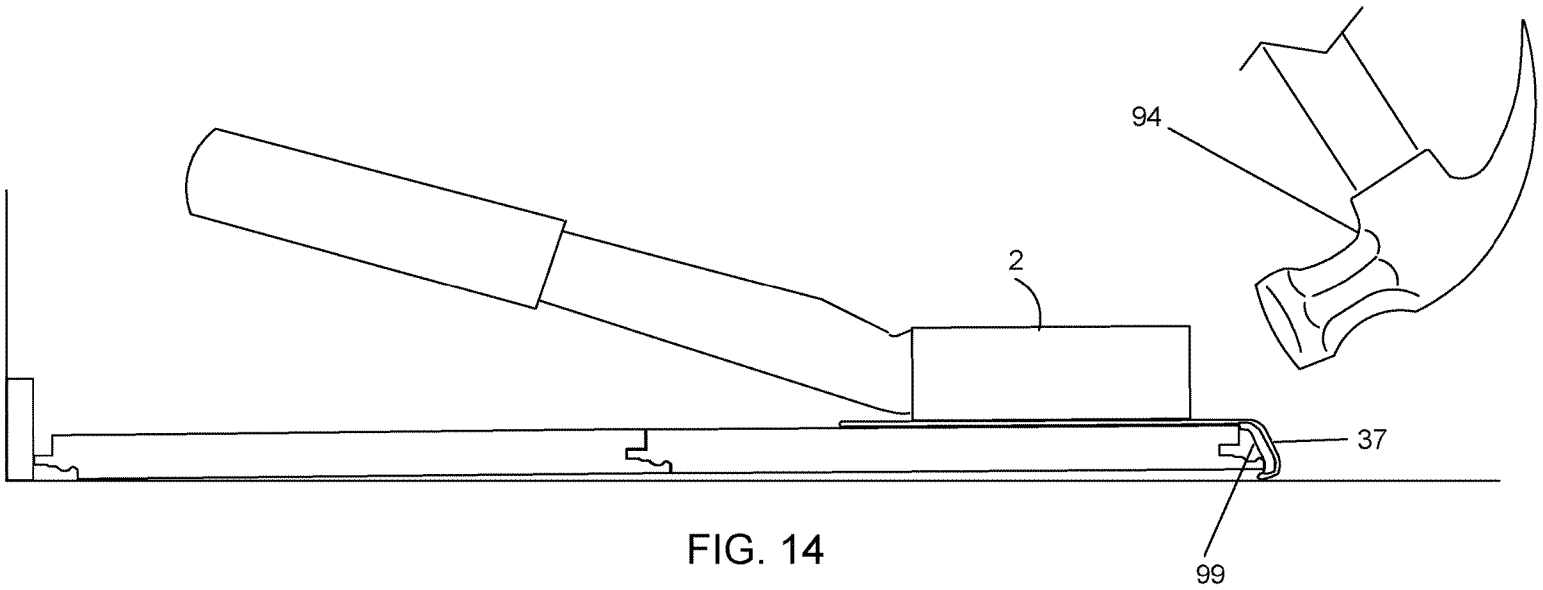
FIG. 14 shows another preferred embodiment of the present invention.

FIG. 14 shows another preferred embodiment of the present invention. In FIG. 14, shock absorption piece 99 has been placed between angled lip 37 and board 10*b*. Shock absorption piece 99 will absorb shock forces when hammer 94 strikes block 2. In one preferred embodiment shock absorption piece 99 is hard foam. It may also be fabricated from rubber, silicone or plastic.

Figure 15:
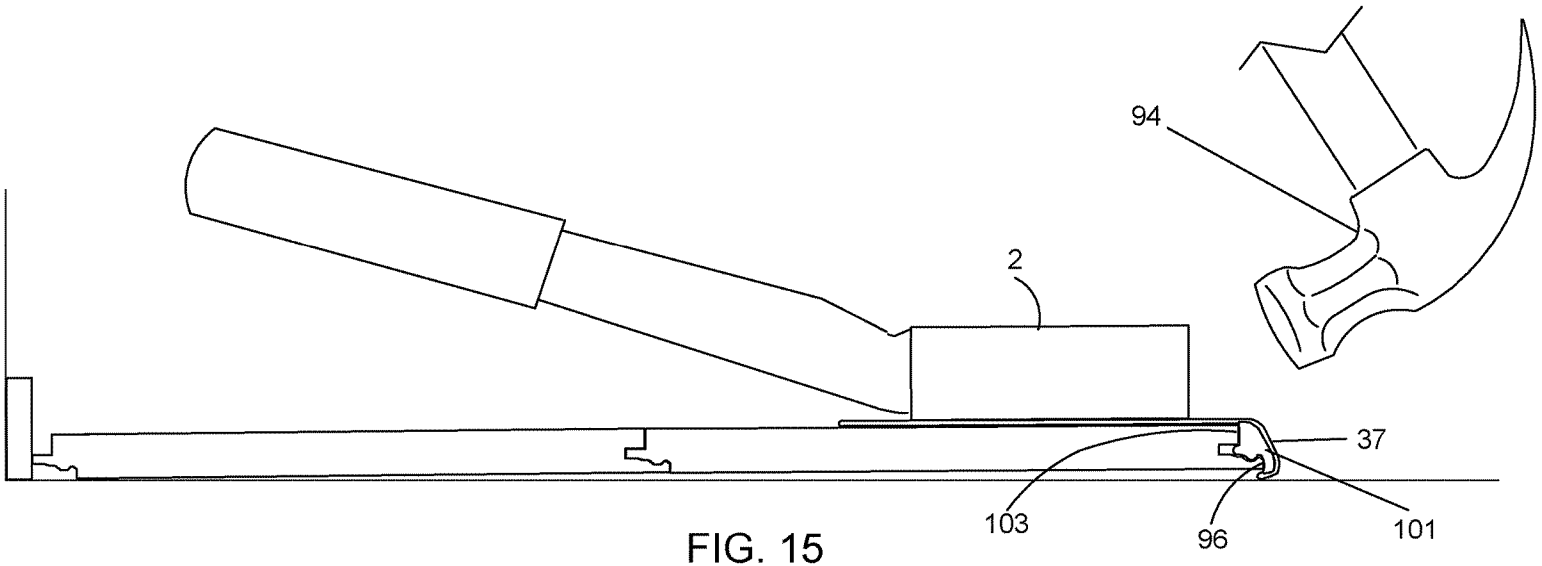
FIG. 15 shows another preferred embodiment of the present invention.

FIG. 15 shows another preferred shock absorption piece 101. Shock absorption piece 101 has been formed to very closely match the curvature of groove side 16 of board 10*b*. This will provide even better shock absorption protection of groove side 16 so that a strike on tapping block 2 would be absorbed by shock absorption piece 101, minimizing the risk of damage to upper groove edge and said lower groove edge Although the above-preferred embodiments have been described with specificity, persons skilled in this art will recognize that many changes to the specific embodiments disclosed above could be made without departing from the spirit of the invention. For example, although the above description stated that block 2 was rigidly connected to puller 3 via rivets, it could also be rigidly connected using other methods. For example block 2 can be welded to puller 3. Therefore, the attached claims and their legal equivalents should determine the scope of the invention.

What is claimed is:

1. A pull bar for pulling together flooring boards utilizing a click-and-lock connection system, said pull bar comprising:

A. a tapping block,

B. a handle rigidly connected at an angle to said tapping block, and

C. a puller rigidly connected to said tapping block, said puller comprising:

i. a lip extending downward from said tapping block wherein said lip is an angled lip that extends downward and is angled away from said tapping block, and ii. a hook connected to said lip, said hook for hooking one of said flooring boards wherein each of said flooring boards comprises a groove side having a lower groove edge and an upper groove edge, wherein said angled lip contacts said upper groove edge and said lower groove edge so that a strike on said tapping block would be absorbed by both said upper groove edge and said lower groove edge.

2. The pull bar as in claim 1, wherein said puller is riveted to said tapping block.

3. The pull bar as in claim 1, wherein each of said flooring boards comprises a lower groove edge, wherein said hook extends under said lower groove edge.

4. The pull bar as in claim 1 wherein said angle of said handle is approximately 20 degrees.

5. The pull bar as in claim 1 wherein said angle of said handle is at least 10 degrees.

6. The pull bar as in claim 1 further comprising a shock absorption device attached to said lip and said hook.

7. A method for using a pull bar for pulling together a first flooring board and a second flooring board utilizing a click-and-lock connection system, each flooring board comprising a tongue side and a groove side, said method comprising the steps of:

A. placing said tongue side of said first flooring board next to said groove side of said second flooring board, B. setting a pull bar on top of said first flooring board, said pull bar comprising:

i. a tapping block, ii. a handle rigidly connected at an angle to said tapping block, and iii. a puller rigidly connected to said tapping block, said puller comprising:

a. a lip extending downward from said tapping block, and b. a hook connected to said lip, said hook for hooking a lower groove edge of said first flooring board, C. pushing downwards on said handle to raise said first flooring board to an insertion angle, D. tapping said tapping block with a blunt instrument to lock said first flooring board to said second flooring board, E. locking said first flooring board to said second flooring board, and F. removing said pull bar from said first flooring board.

8. The method as in claim 7, wherein said puller is riveted to said tapping block.

9. The method as in claim 8, wherein said lip is an angled lip that extends downward and is angled away from said tapping block.

10. The method as in claim 9, wherein each of said flooring boards comprises a groove side having a lower groove edge and an upper groove edge, wherein said angled lip contacts said upper groove edge and said lower groove edge so that a strike on said tapping block would be absorbed by both said upper groove edge and said lower groove edge.

11. The method as in claim 8, wherein each of said flooring boards comprises a lower groove edge, wherein said hook extends under said lower groove edge.

12. The method as in claim 8 wherein said angle of said handle is approximately 20 degrees.

13. The method as in claim 8 wherein said angle of said handle is at least 10 degrees.

14. The method as in claim 8 further comprising a shock absorption device attached to said lip and said hook.

* * * * *